US007901303B2

(12) United States Patent
Toyosawa

(10) Patent No.: US 7,901,303 B2
(45) Date of Patent: Mar. 8, 2011

(54) GOLF TEE

(75) Inventor: Issei Toyosawa, Tokyo (JP)

(73) Assignee: Daiya Corporation, Tokyo (JP)

( * ) Notice: Subject to any disclaimer, the term of this patent is extended or adjusted under 35 U.S.C. 154(b) by 207 days.

(21) Appl. No.: 12/224,068

(22) PCT Filed: Jan. 24, 2007

(86) PCT No.: PCT/JP2007/051068

§ 371 (c)(1),
(2), (4) Date: Aug. 15, 2008

(87) PCT Pub. No.: WO2007/105379

PCT Pub. Date: Sep. 20, 2007

(65) Prior Publication Data

US 2010/0173729 A1 Jul. 8, 2010

(30) Foreign Application Priority Data

Feb. 22, 2006 (JP) ..... 2006-045161

(51) Int. Cl.
*A63B 57/00* (2006.01)

(52) U.S. Cl. ..... 473/387; 473/390

(58) Field of Classification Search ..... 473/387–403, 473/579, 580; D21/717, 718
See application file for complete search history.

(56) References Cited

U.S. PATENT DOCUMENTS

| | | | | | |
|---|---|---|---|---|---|
| 1,142,997 | A | * | 6/1915 | True | 473/388 |
| 1,554,321 | A | * | 9/1925 | Banigan | 473/388 |
| 1,614,499 | A | * | 1/1927 | Stirton | 473/389 |
| 1,738,596 | A | * | 12/1929 | McLeod | 473/391 |
| D81,315 | S | * | 6/1930 | McLeod | D21/717 |
| 2,612,373 | A | * | 9/1952 | Pierce | 473/388 |
| 2,626,806 | A | * | 1/1953 | Carlton | 473/579 |
| 3,690,676 | A | * | 9/1972 | Costa | 473/398 |
| 3,697,082 | A | * | 10/1972 | Di Laura et al. | 473/388 |
| 3,831,943 | A | * | 8/1974 | Popplewell | 473/579 |
| 3,993,310 | A | * | 11/1976 | Popplewell | 473/579 |
| 5,421,587 | A | * | 6/1995 | Mao-Huang | 473/579 |
| 6,110,059 | A | * | 8/2000 | Haggarty | 473/387 |
| 2009/0093323 | A1 | * | 4/2009 | Caya | 473/387 |

FOREIGN PATENT DOCUMENTS

| | | |
|---|---|---|
| JP | 62-139678 | 6/1987 |
| JP | 05-082459 | 11/1993 |
| JP | 06-066733 | 9/1994 |
| JP | 2001-259100 | 9/2001 |

* cited by examiner

*Primary Examiner* — Steven Wong
(74) *Attorney, Agent, or Firm* — Flynn, Thiel, Boutell & Tanis,P.C.

(57) ABSTRACT

A golf tee with excellent support stability is provided. The golf tee is capable of preventing itself from being driven together with a golf ball. The golf tee is a truncated conical golf tee having a hollow structure with a lower end placed on the ground surface and an upper end on which a golf ball is placed. The golf tee has shape restoration properties. The golf tee has a plurality of columns extending from the lower end toward the upper end, sidewalls thinner than the column formed between respective columns, and a plurality of vents provided in each of the sidewalls.

19 Claims, 10 Drawing Sheets

GOLF TEE

FIELD OF THE INVENTION

The present invention relates to a golf tee used by being placed on the surface of the ground.

BACKGROUND OF THE INVENTION

A currently used golf tee has a structure having a base portion 51 on which a golf ball is placed and a stick-like tee portion 52 extending downward from the center of the base portion 51 as shown in FIG. 11. This golf tee is used by sticking the tee portion into the ground.

Therefore, problems are caused, for example, when the surface of the ground is damaged, or the golf tee cannot be stuck in the ground because the ground is frozen in a cold season.

Moreover, since the height of the base portion is changed depending on the sticking depth of the tee portion, height adjustment upon tee up is difficult.

When a golf ball is hit by a golf club by using the golf tee (hereinafter, referred to as "upon impact"), the golf tee is also hit at the same time, and, as a result, the golf tee also flies to somewhere together with the golf ball (hereinafter, referred to as "accompanying flight").

In this case, the golf tee may be lost, or the golf tee may be broken.

Incidentally, in place of the golf tee of the type that it is stuck into the ground, golf tees of the type that they are placed on the surface of the ground have been provided (for example, see Japanese Patent Application Laid-Open No. S62-139678; Japanese Utility Model Application Laid-Open No. H05-091736; Japanese Utility Model Application Laid-Open No. H06066733; Japanese Patent Application Laid-Open No. 2001-259100; Japanese Patent Application Laid-Open No. 2005-137621; and Japanese Utility Model Application Laid-Open No. H07-043091).

These tubular (cylindrical) or circular truncated conical golf tees are the golf tees of the type that they are used by being placed on the surface of the ground; therefore, the problems that arise when the surface of the ground is damaged and the golf tee cannot be stuck in the ground can be solved.

However, since the golf tees described in the first five of the above mentioned patent documents are tubular, satisfactory support stability for supporting a golf ball is not obtained merely by placing them on the surface of the ground.

Particularly, since a lawn is generally grown on tee ground, the above described golf tees may fall down due to the obstacle of the lawn.

Moreover, not only in the case in which the surface of the ground is not flat, but also in the case in which, for example, wind blows, the golf tees described in the first five of the above mentioned patent documents may fall down.

On the other hand, the golf tee described in the sixth of the above mentioned patent documents is circular truncated conical; therefore, comparatively, it has support stability when compared with the above described cylindrical golf tees.

However, since it readily receives the influence of wind or the like, the support stability is not satisfactory.

Moreover, since it is manufactured by hooking one end of a flat member, it may be damaged every time shock is applied to the golf tee.

Therefore, these golf tees of the abovementioned patent documents do not satisfactorily satisfy support stability and accompanying flight prevention of the golf tees.

SUMMARY OF THE INVENTION

The present invention has been accomplished in view of the foregoing circumstances, and it is an object to provide golf tees which are excellent in support stability and capable of preventing the accompanying flight of the golf tees as much as possible.

The present inventors have carried out extensive studies for solving the above described problems and found out that the above described problems can be solved by causing sidewall portions of a golf tee to be thin for reducing the weight and providing supporting shafts for improving support stability, thereby accomplishing the present invention.

More specifically, the golf tee of the present invention is a circular truncated conical golf tee having a hollow structure having a bottom end portion placed on a ground surface and a top end portion on which a golf ball is placed upon use, the golf tee being characterized by having a shape restoring property, wherein the golf tee has a plurality of supporting shafts extending from the bottom end portion toward the top end portion, sidewall portions thinner than the supporting shafts are formed respectively between the supporting shafts, and a plurality of vent holes are provided in each of the sidewall portions.

The golf tee of the present invention achieves weight reduction by causing the sidewall portions to be thinner than the supporting shafts and providing the vent holes.

The above described golf tee is a circular truncated cone having a hollow structure.

Therefore, the golf tee of the present invention satisfactorily suppress the distance of accompanying flight since, in addition to the fact that the weight of the golf tee is light, the golf tee receives air resistance not only from the outer surface of the circular truncated conical golf tee but also from the hollow portion and vent holes.

Moreover, since the above described golf tee is circular truncated conical, the golf tee can be prevented from falling down due to influence of winds or the like.

More specifically, although a golf tee having a light weight generally readily falls down due to influence of winds, or the like, the golf tee of the present invention is not readily affected by winds, or the like since the winds pass through the vent holes even if the winds, or the like blows since the vent holes are provided in the sidewall portions.

Furthermore, even when the golf ball is placed on the top end portion, the above described golf tee can keep the shape since the golf ball is supported by the supporting shafts thicker than the sidewall portions.

Therefore, the golf tee of the present invention is excellent in support stability although it has a light weight.

The golf tee of the present invention has the shape restoring property.

Therefore, even when shock is applied to the golf tee upon impact together with that to the golf ball, damage of the golf tee is suppressed. The above described golf tee has the light weight and is also good in resilience; therefore, loss of impact energy (kinetic energy of a golf club) caused by the golf tee can be suppressed. Therefore, the impact energy can be efficiently transmitted to the golf ball.

Since the above described golf tee has the shape restoring property, for example, it can be folded and housed in a pocket, or the like, and it can be prevented from falling down from the pocket since at that point it achieves a restored state.

Therefore, according to the golf tee of the present invention, excellent support stability can be achieved, and accompanying flight of the golf tee can be prevented as much as possible.

In the above described golf tee, it is preferred that the closer the vent holes to the top end portion from the bottom end portion, the larger the areas of the vent holes.

In the above described golf tee, since the vent holes in the top end portion side of the golf tee have larger areas, winds more readily pass through in the top end portion side of the golf tee. As a result, the top end portion side of the golf tee does not readily receive the influence of winds; therefore, support stability of the golf tee is improved.

In the above described golf tee, it is preferred that the vent holes are provided at approximately equal intervals from the bottom end portion toward the top end portion, and the golf tee can be cut by a plane perpendicular to a longitudinal direction of the golf tee.

Since the above described golf tee can be cut in this manner, the position of tee up can be caused to have a desired height. More specifically, when the position of tee up is desired to be low, the golf tee is cut at the position of the golf tee by a plane perpendicular to the longitudinal direction of the golf tee.

In this process, when the golf tee is to be cut, the vent holes can serve as measures of the cut position in the height direction since the vent holes are provided at approximately equal intervals in the longitudinal direction.

Therefore, when the heights of a plurality of golf tees are desired to be adjusted, the golf tees can be cut by using the positions of predetermined vent holes as measures; therefore, variation of the heights among the golf tees is small.

In the above described golf tee, it is preferred that a plurality of the vent holes provided in a direction perpendicular to the longitudinal direction of the golf tee have a same shape, and the golf tee can be cut by a plane crossing the center of each of the vent holes.

As described above, the above described golf tee can be cut; therefore, the position of tee up can be caused to have a desired height.

More specifically, when the position of tee up is desired to be low, the golf tee can be cut at the position of the golf tee by a plane perpendicular to the longitudinal direction of the golf tee.

In this process, when the vent holes have the same shape, they can be used as measures of the cut position in the lateral direction (horizontal direction) when the golf tee is to be cut.

More specifically, when it is cut by using the above described vent holes as measures, it can be readily cut by the plane perpendicular to the longitudinal direction of the golf tee.

In this case, the golf tee is cut by the plane crossing the center of each of the vent holes; therefore, the vent holes of the top end portion of the golf tee have the same shape.

Therefore, when the golf ball is placed on the above described golf tee, the golf ball can be more stabilized.

Herein, it is preferred that a mark for cutting the vent hole is provided in the periphery of the vent hole.

When the mark is provided, it can be readily cut by the plane perpendicular to the longitudinal direction of the golf tee by cutting it along the mark.

In the above described golf tee, it is preferred that the bottom end portion comprises bottom end projecting portions formed by the supporting shafts and notched portions notching the sidewall portions.

When the bottom end projecting portions are provided in the bottom end portion, obstacles present on the ground surface can be avoided as much as possible.

More specifically, even when the golf tee is placed on a ground surface such as a lawn-grown tee ground, the golf tee of the present invention can further improve the support stability.

It is preferred that the notched portion has an angular shape.

In this case, obstacles such as lawns present on the ground surface can be more reliably avoided.

In the above described golf tee, it is preferred that the top end portion comprises top end projecting portions formed by the supporting shafts and the sidewall portions between the mutually adjacent vent holes and parts of the vent holes.

When the top end projecting portions are provided in the top end portion, in the case in which the golf ball is placed on the golf tee of the present invention, the top end projecting portions of the golf tee and the golf ball are brought into contact with each other.

Therefore, according to the above described golf tee, since part of the golf ball achieves a floating state, loss of the impact energy upon impact can be suppressed.

The above described golf tee is preferred to comprise polyethylene and/or polypropylene.

In this case, a golf tee having satisfactory flexibility and good resilience can be provided.

According to the golf tee of the present invention, excellent support stability can be achieved, and accompanying flight of the golf tee can be prevented as much as possible.

DETAILED DESCRIPTION

Figure 1:
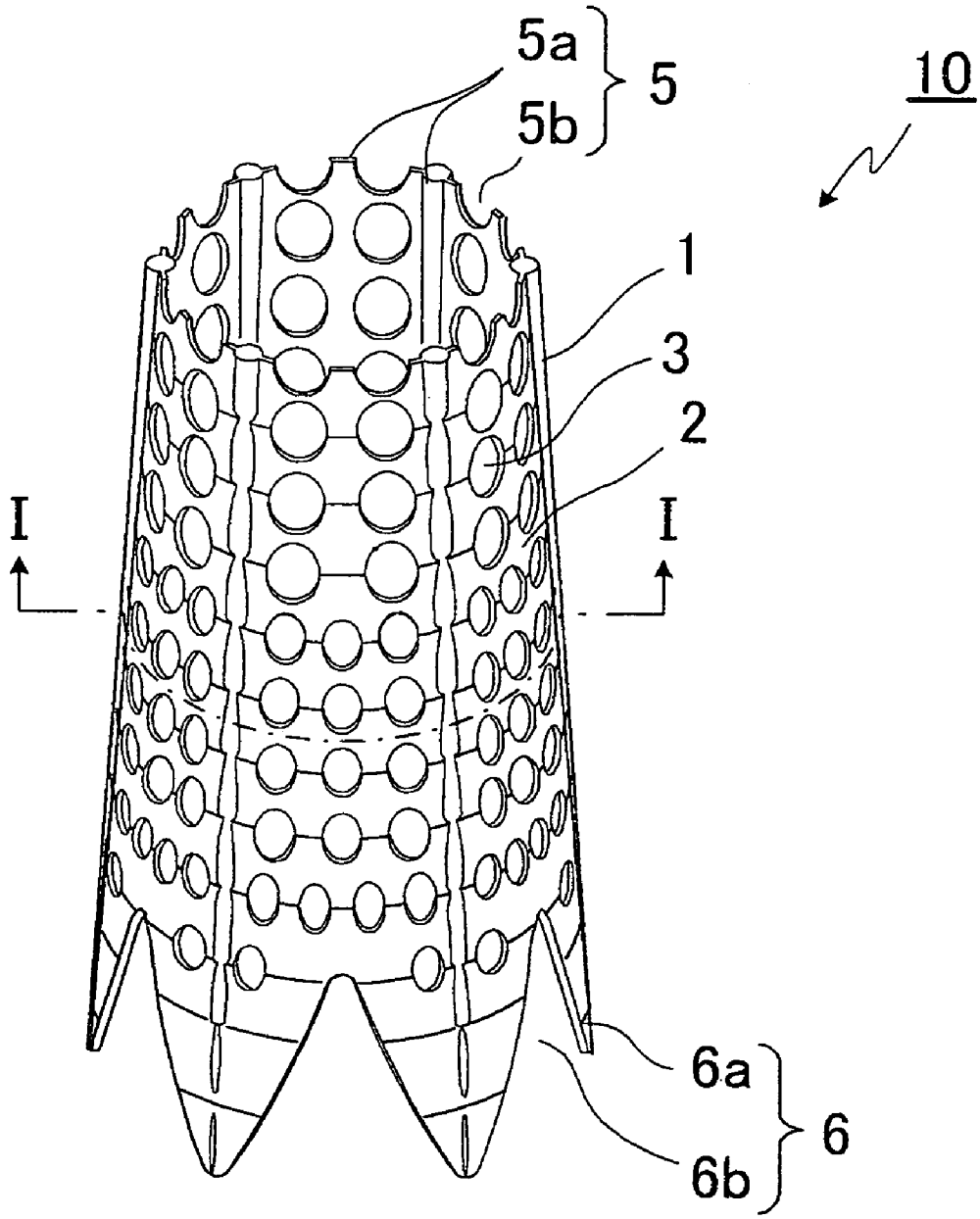
FIG. 1 is a perspective view schematically showing an embodiment of a golf tee of the present invention.

Hereinafter, with reference to drawings, preferred embodiments of the present invention will be described in detail.

Note that, in the drawings, same elements are denoted by the same reference numerals, and redundant descriptions are omitted.

Unless otherwise stated, the positional relations of, for example, top, bottom, left, and right are based on the positional relations shown in the drawings.

Furthermore, the dimensional ratios of the drawings are not limited to the ratios of the drawings.

Figure 2:
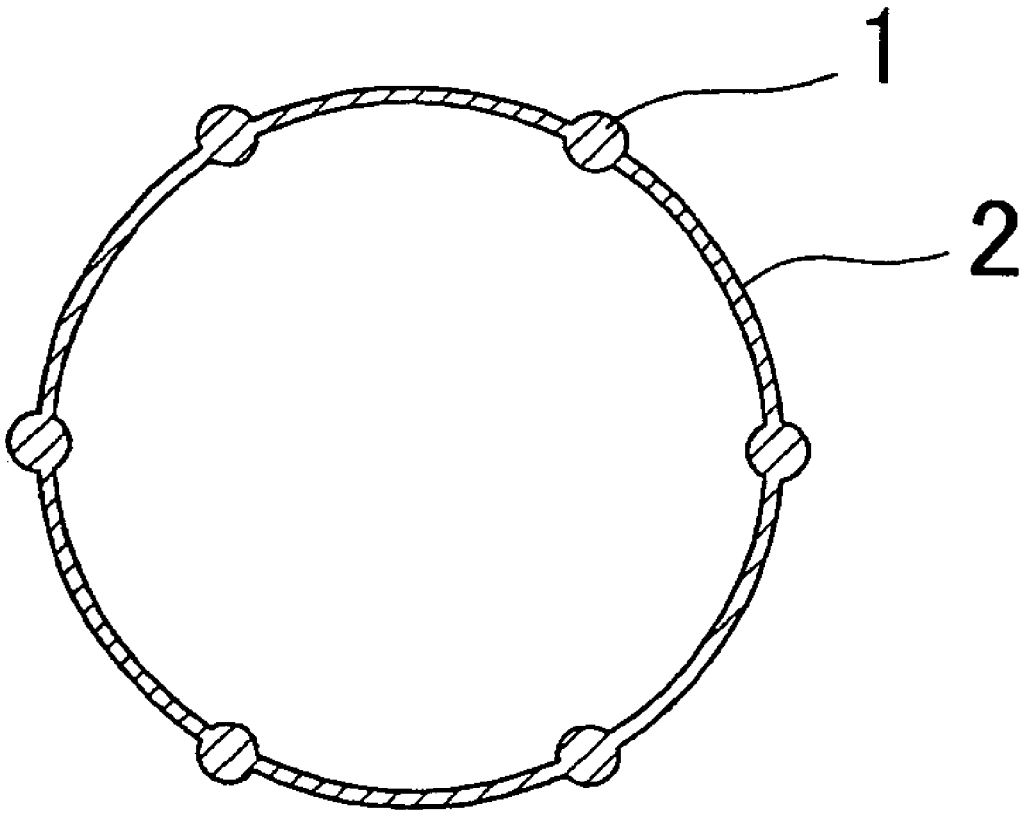
FIG. 2 is a cross sectional view of the line I-I of the golf tee shown in FIG. 1.

FIG. 1 is a perspective view schematically showing an embodiment of a golf tee of the present invention, and FIG. 2 is a cross sectional drawing of the line I-I of the golf tee shown in FIG. 1.

As shown in FIG. 1, the golf tee 10 according to the present embodiment is a circular truncated cone having a hollow structure.

The golf tee 10 has a top end portion 5 and a bottom end portion 6 and is used by placing the bottom end portion 6 on the ground surface and placing a golf ball on the top end portion 5.

As shown in FIG. 1, the circular truncated conical golf tee 10 has supporting shafts 1 extending from the bottom end portion 6 toward the top end portion 5.

As shown in FIG. 2, six supporting shafts 1 are disposed at approximately equal intervals.

In addition, sidewall portions 2 thinner than the supporting shafts 1 are formed between the supporting shafts 1, respectively.

The sidewall portion 2 is composed of a member that is excellent in the shape restoring property and is arched between the supporting shafts 1 so that the plane of the golf tee 10 cut in the direction (hereinafter, referred to as "circumferential direction") that is perpendicular to the longitudinal direction thereof is circular.

In addition, as shown in FIG. 1, a plurality of vent holes 3 are provided in the sidewall portions 2. The vent holes 3 have elliptical shapes and are provided at approximately equal intervals so that the closer they get to the top end portion 5 from the bottom end portion 6, the larger the areas of the vent holes 3.

Furthermore, a plurality of the vent holes 3 are also provided in the circumferential direction of the golf tee 10, and the vent holes 3 provided in the same circumferential direction have the same shape.

In other words, the vent holes 3 provided in the same circumferential direction have the same shape; however, the vent holes 3 provided in the same direction directed from the bottom end portion 6 to the top end portion 5 of the golf tee 10 do not have the same shape, and the areas thereof are gradually increased as they get close to the top end portion 5.

The bottom end portion 6 of the above described golf tee 10 comprises bottom end projecting portions 6*a* extending in the longitudinal direction and formed by the supporting shafts 1 and notched portions 6*b* formed by angularly notching the lower ends of the sidewall portions 2.

On the other hand, the top end portion 5 of the above described golf tee 10 comprises top end projecting portions 5*a* extending in the longitudinal direction and formed by the supporting shafts 1 and the sidewall portions 2 between the mutually adjacent vent holes 3 and parts 5*b* of the vent holes 3.

Therefore, in the above described golf tee 10, the bottom end projecting portions 6*a* contact the ground surface, and the top projecting portions 5*a* contact a golf ball.

The weight of the golf tee 10 according to the present embodiment is reduced as a result of reducing the thickness of the sidewall portions 2 and providing the vent holes 3, and support stability of the golf tee 10 is achieved as a result of providing the supporting shafts 1 thicker than the sidewall portions 2.

Note that, since the weight of the above described golf tee 10 is reduced, the cost of the raw materials of the golf tee 10 is also reduced.

The thickness of the supporting shaft 1 in this case is preferably 0.4 to 1.0 mm from the viewpoints of the support stability of a golf ball and weight reduction of the golf tee.

The thickness of the sidewall portion 2 is preferably 0.2 to 0.9 mm from the viewpoints of the shape restoring property and weight reduction of the golf The above described golf tee 10 is a circular truncated cone having the hollow structure.

Therefore, when the golf tee of the present invention undergoes accompanying flight, the air resistance that the outer surface of the golf tee receives is large.

The above described golf tee 10 has the center of gravity at a lower position compared with cylindrical ones since it is circular truncated cone. Therefore, the golf tee can be prevented from being fallen down by the influence of a wind or the like.

The above described golf tee 10 has the vent holes 3 in the sidewall portions 2; therefore, even when a wind or the like blows, it is not readily affected by the wind or the like since the wind passes through the vent holes 3.

Furthermore, when the above described golf tee 10 is placed on the ground surface, winds more readily pass through at an upper part of the golf tee 10 since the areas of the upper vent holes 3 of the golf tee are large.

Therefore, the above described golf tee 10 is particularly excellent in the support stability.

Regarding the above described golf tee 10, when the golf tee 10 is placed on the ground surface, the angle formed by the supporting shafts and sidewall portions of the golf tee and the ground surface is preferably 60 to 89 degrees.

When the angle is less than 60 degrees, upon impact, a golf club readily hits the golf tee 10 before the golf ball compared with the case in which the angle is within the above described range.

Meanwhile, when the angle exceeds 89 degrees, it readily falls down due to the influence of winds or the like compared with the case in which the angle is within the above described range.

The above described golf tee 10 has the shape restoring property.

Therefore, even when shock is applied to the golf tee together with the golf ball upon impact, damage of the golf tee is suppressed.

The golf tee of the present invention has a light weight and is also good in resilience; therefore, loss of impact energy due to the golf tee 10 is suppressed.

Moreover, since the above described golf tee 10 has the shape restoring property, for example, it can be folded and housed in a pocket or the like. At that point, it can be prevented from falling down from the pocket since it achieves a restored state.

Such shape restoring property can be achieved by manufacturing the golf tee 10 by a thermoplastic resin and forming the sidewall portions to be thin as described above.

No particular limitation is imposed on the above described thermoplastic resin; however, from the viewpoint of recycling, for example, polyolefins such as polyethylene and polypropylene and elastomers such as rubber and synthetic rubber are preferably used.

These may be used singularly or in combination.

In this case, the golf tee excellent in the shape restoring property is obtained.

When the above described golf tee 10 is to be disposed of, the golf tee that is to be disposed of is melted and formed again, thereby using it as a golf tee again.

Among these, the polyethylene is more preferred.

In this case, a golf tee having more satisfactory flexibility and excellent in resilience can be provided.

Particularly among polyethylenes, a low-density soft polyethylene is further preferred.

When an environmental aspect is taken into consideration, the above described thermoplastic resin is preferably a biodegradable resin manufactured from a starch (corn starch), cellulose, carrageenan, chitin/chitosan, etc. In the biodegradable resin, wood powder, paper fibers, etc. may be mixed.

The golf tee 10 according to the present embodiment is excellent in support stability and can prevent accompanying flight of the golf tee as much as possible since it has the above described configuration.

The above described golf tee 10 can be cut.

Therefore, the position of tee up can be caused to be at a desired height.

More specifically, when the position of tee up is desired to be low, the golf tee can be cut at the position of the golf tee 10 so that it is cut by the plane perpendicular to the longitude direction of the golf tee.

In the above described golf tee 10, the vent holes 3 are provided at approximately equal intervals in the longitudinal direction.

Therefore, when the golf tee 10 is to be cut, the vent holes 3 may be used as measures of the cut position in the height direction.

As a result, when the heights of a plurality of golf tees 10 are desired to be adjusted, the golf tees 10 can be cut by using the position of a predetermined vent hole 3 as a measure; therefore, variation of height among the golf tees 10 is reduced.

In the above described golf tee 10, the vent holes 3 provided in the circumferential direction have the same shape; therefore, when the golf tee 10 is to be cut, they can be used as measures of the cut position in the lateral direction (horizontal direction).

More specifically, when the positions of the above described vent holes 3 are used as measures to cut it, it can be readily cut by the plane perpendicular to the longitudinal direction of the golf tee.

In this case, it is preferred to cut by the plane crossing the center of each of the vent holes.

As a result, the vent holes of the top end portions 5 of the golf tee 10 have the same shape.

More specifically, it is cut by the plane crossing the center of the vent holes 3 having an elliptical shape; therefore, each of the parts 5*b* of the vent holes 3 constituting the top end portion 5 has a U-shape.

Therefore, when a golf ball is to be placed on the above described golf tee 10, the golf ball can be stabilized more.

In the above described golf tee 10, a mark for cutting the vent hole 3 is preferably provided in the periphery of the vent hole 3.

When the mark is provided, it can be readily cut by the plane perpendicular to the longitudinal direction of the golf tee by cutting it along the mark.

Figure 3:
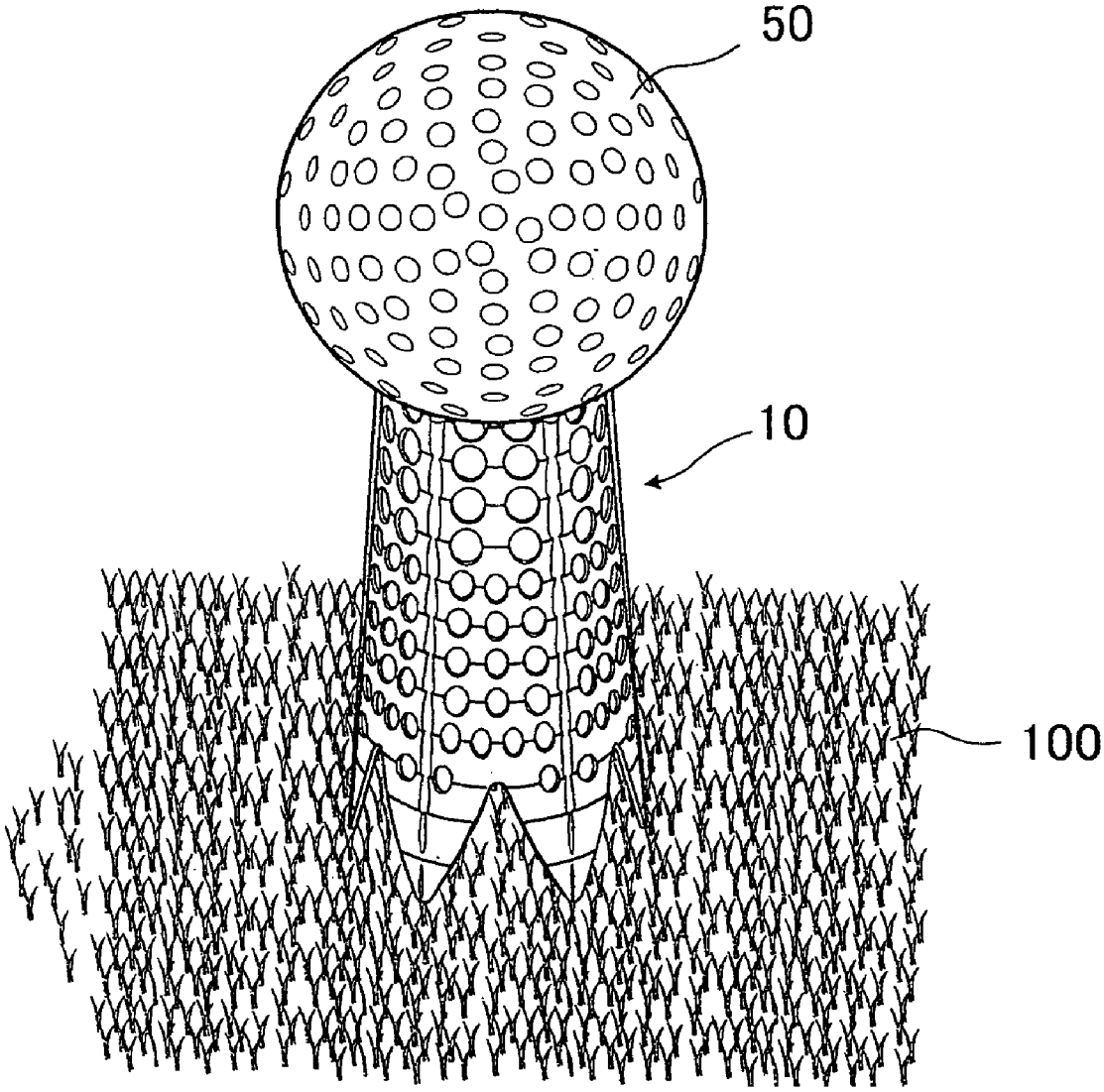
FIG. 3 is a perspective view schematically showing the state in which tee up is carried out by using the golf tee according to the present embodiment.

FIG. 3 is a perspective view schematically showing the state in which tee up is carried out by using the golf tee according to the present embodiment.

As shown in FIG. 3, the golf tee 10 according to the present embodiment is placed on a ground surface 100 so that the bottom end portion 6 side is at the ground surface 100, and a golf ball 50 is placed above the top end portion 5 of the golf tee 10.

In the golf tee 10 according to the present embodiment, the bottom end projecting portions 6*a* are provided in the bottom end portion 6 as described above.

Therefore, when the golf tee 10 is placed on the ground surface 100, the bottom end projecting portions 6*a* are in contact with the ground surface 100.

Consequently, space is generated between the ground surface 100 and the bottom end portion 6 of the golf tee 10 therefore, even when the ground surface 100 has irregularities, when obstacles such as pebbles are present, or when a lawn, etc. is grown, the golf tee 10 can be placed on the ground surface 100 by avoiding them.

Moreover, even when the golf ball 50 is placed on the top end portion 5*a*, the above described golf tee 10 can maintain the shape since the golf ball 50 is supported by the supporting shafts 1 which are thicker than the sidewall portions 2.

Thus, the above described golf tee 10 is excellent in the support stability.

In the above described golf tee 10, the top end projecting portions 5*a* are provided in the top end portion 5 as described above.

Therefore, when the golf ball 50 is placed on the top end portion 5 of the golf tee 10, the top end projecting portions 5*a* are in contact with the golf ball 50.

As a result, parts of the top end portions 5*a* of the golf tee 10 and the golf ball are caused to be in a floating state; therefore, loss of impact energy upon impact can be satisfactorily suppressed.

Figure 4A:
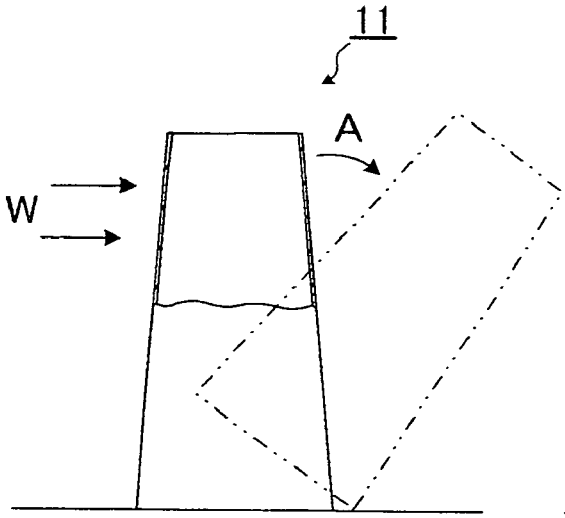
FIG. 4(A) is an illustrative drawing for explaining influence of winds against a circular truncated cone golf tee having no vent holes.
Figure 4B:
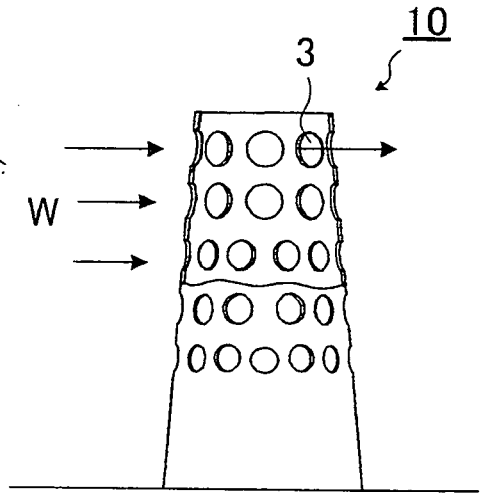
FIG. 4(B) is an illustrative drawing for explaining influence of winds against the golf tee according to the present embodiment.

FIG. 4 (A) is an explanatory drawing for explaining influence of winds against a circular truncated conical golf tee having no vent holes, and FIG. 4 (B) is an explanatory drawing for explaining influence of winds against the golf tee according to the present embodiment.

As shown in FIG. 4 (A), when the circular truncated cone golf tee 11 having no vent holes is placed on the ground surface, and winds W are caused to blow against the golf tee 11 from a predetermined direction, the golf tee 11 readily falls down in the direction of an arrow A when particularly strong winds blow against an upper part of the golf tee 11 although the golf tee 11 has stability since it is circular truncated conical.

On the other hand, as shown in FIG. 4 (B), when the golf tee 10 according to the present embodiment is similarly placed on the ground surface, and the winds W are caused to blow against the golf tee 10 from a predetermined direction, the winds W pass through the vent holes 3 since the golf tee 10 has the vent holes 3.

Particularly, in the above described golf tee 10, the closer the vent holes 3 to the top, the larger the vent holes 3; therefore, even when particularly strong winds blow against upper part of the golf tee 10, fall down of the golf tee 10 can be prevented.

Figure 5A:
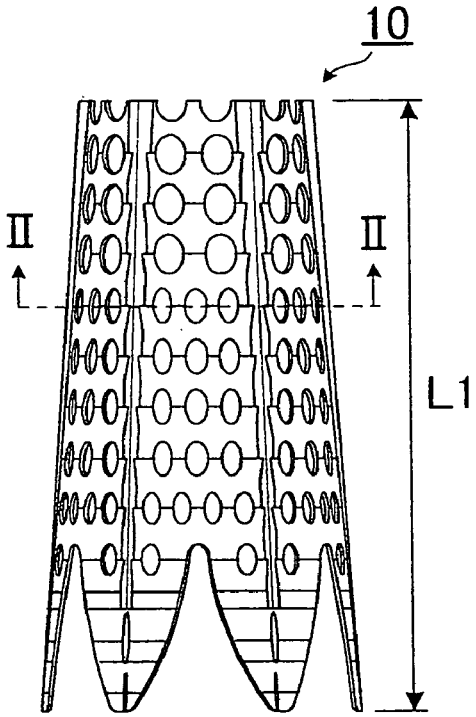
FIGS. 5(A) and (B) are front views for explaining a method of cutting the golf tee according to the present embodiment.
Figure 5B:
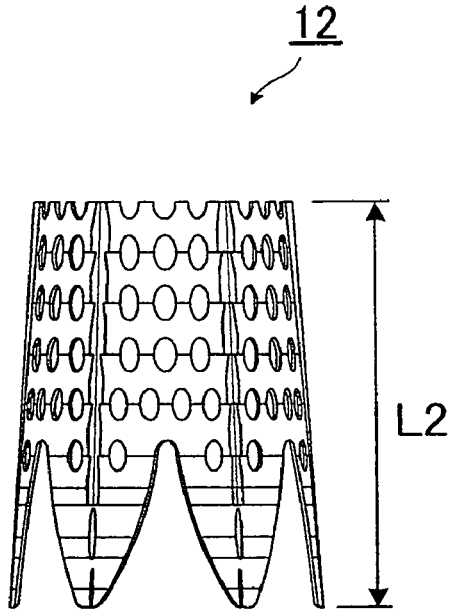

FIGS. 5 (A) and (B) are front views for explaining a method of cutting the golf tee according to the present embodiment.

When the golf tee 10 according to the present embodiment is desired to have a desired height, the golf tee 10 according to the present embodiment can be cut at an arbitrary height.

More specifically, when the golf tee 10 having a predetermined height L1 is cut by, for example, a line II-II as shown in FIG. 5 (A), a golf tee 12 having a desired height L2 shown in FIG. 5 (B) can be obtained.

Figures 6A, 6B:
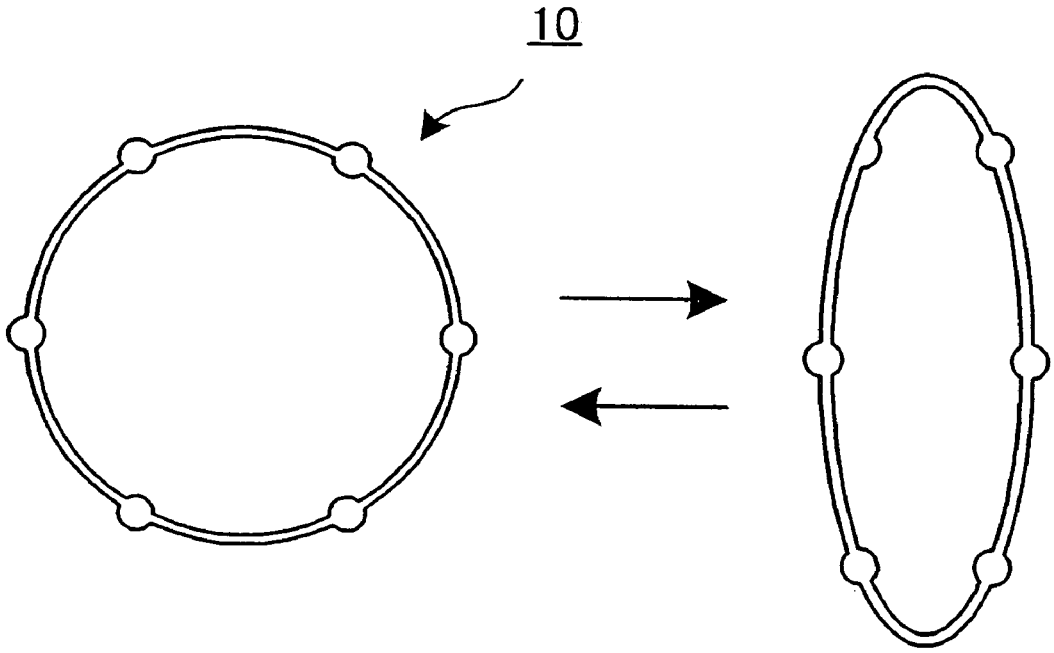
FIGS. 6(A) and (B) are cross sectional views for explaining the shape restoring property of the golf tee according to the present embodiment.

FIGS. 6 (A) and (B) are cross sectional drawings for explaining the shape restoring property of the golf tee according to the present embodiment.

As shown in FIG. 6 (A), for example when both sides of the golf tee 10 according to the present embodiment are pressed by fingers, the golf tee 10 can be readily deformed.

Then, when the above described golf tee 10 is released from pressing, the deformed golf tee 10 as shown in FIG. 6 (B) is restored to the original state.

Figure 7:
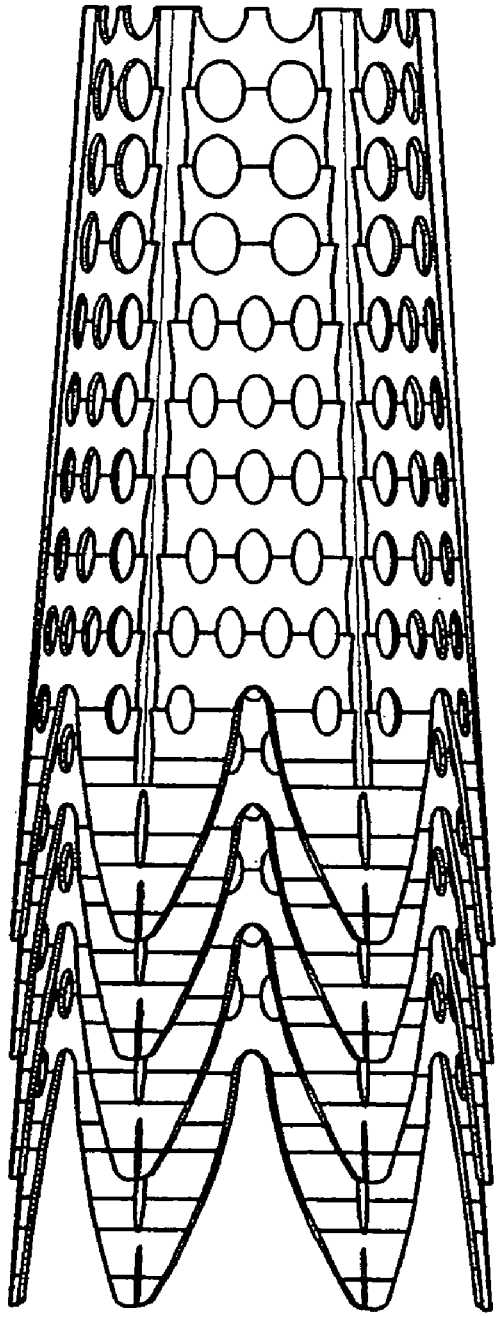
FIG. 7 is a front view for explaining the state in which the golf tees according to the present embodiment are superimposed.

FIG. 7 is a front view for explaining the state in which the golf tees according to the present embodiment are superimposed.

As shown in FIG. 7, the golf tee 10 according to the present embodiment is a circular truncated cone having a hollow structure; therefore, the plurality of golf tees 10 can be superimposed in the longitudinal direction of the golf tees 10.

As a result, the superimposed plurality of golf tees 10 can be carried and stored at the same time.

The golf tee 10 according to the present embodiment is manufactured by melting a predetermined thermoplastic resin, pouring it to a mold having the shape of the golf tee 10, and cooling it.

Note that, the manufacturing method is not limited to this.

A preferred embodiment of the present invention has been described above; however, the present invention is not limited to the above described embodiment.

For example, in the above described embodiment, the number of the supporting shafts 1 of the golf tee 10 is six; however, no particular limitation is imposed on the number of the supporting shafts 1 as long as it is plural.

Preferably, the number of the supporting shafts is three to ten.

If the number of the supporting shafts is less than three, support stability is tend to be lowered compared with the case in which the number of the supporting shafts is within the above described range; and, if the number of the supporting shafts exceeds ten, accompanying flight of the golf tee 10 cannot be satisfactorily prevented since the weight of the golf tee 10 is increased compared with the case in which the number of the supporting shafts is within the above described range.

Figure 8A:
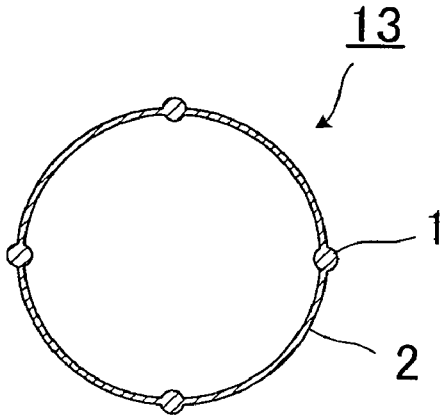
FIGS. 8(A) and (B) are cross sectional views schematically showing golf tees according to other embodiments.
Figure 8B:
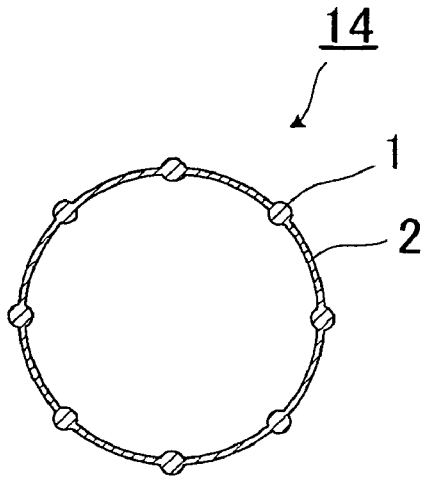
Figure 9A:
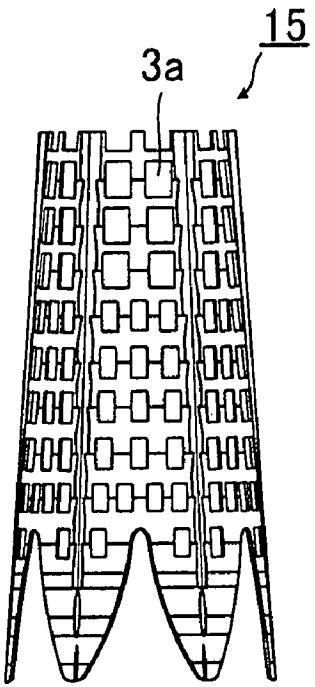
FIGS. 9(A), (B), (C), (D), and (E) are front views schematically showing golf tees according to other embodiments.
Figure 9B:
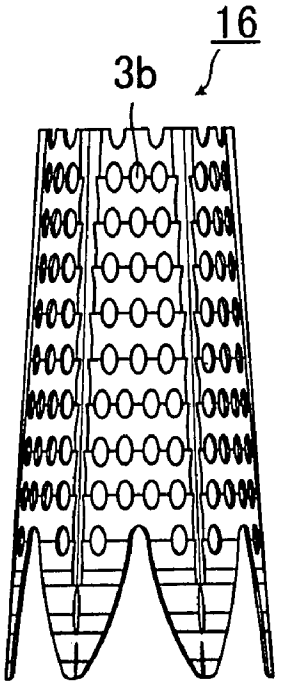
Figure 9C:
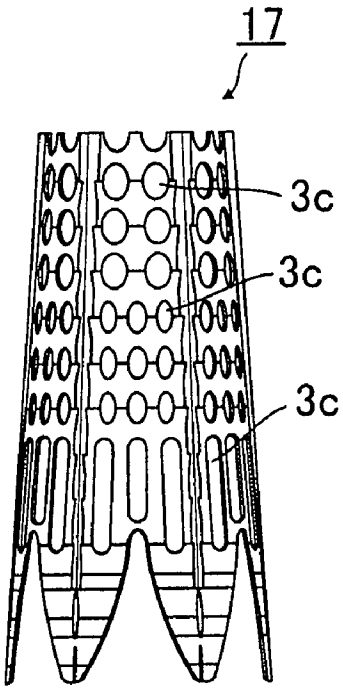
Figure 9D:
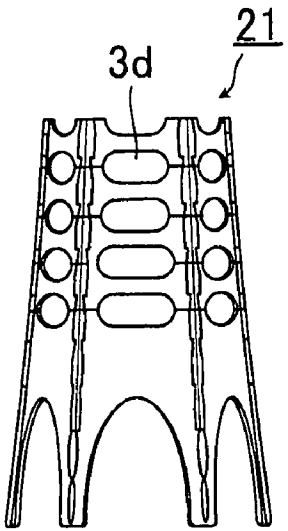
Figure 9E:
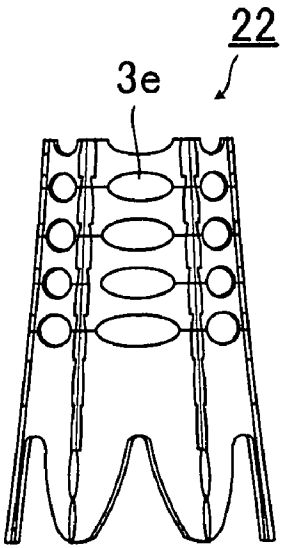

FIGS. 8 (A) and (B) are cross sectional drawings schematically showing golf tees according to other embodiments. As shown in FIG. 8 (A), the golf tee 13 has four supporting shafts 1 which are disposed at approximately equal intervals.

In addition, the sidewall portions 2 thinner than the supporting shafts 1 are formed between the supporting shafts 1, respectively.

On the other hand, as shown in FIG. 8 (B), the golf tee 14 has eight supporting shafts 1 which are disposed at approximately equal intervals.

In addition, the sidewall portions 2 thinner than the supporting shafts 1 are formed between the supporting shafts 1, respectively.

In the above described embodiments, the vent hole 3 has an elliptical shape; however, it may have, for example, a circular or polygonal shape.

The vent holes are provided so that the closer they get to the top end portion 5 from the bottom end portion 6, the larger the areas of the vent holes 3; however, the areas of the vent holes 3 may be the same, and they are not required to have constant areas.

The vent holes 3 provided in the same circumferential direction have the same shape; however, they may be different.

FIGS. 9 (A), (B), (C), (D), and (E) are front views schematically showing golf tees according to other embodiments.

All of a plurality of vent holes 3*a* of the golf tee 15 may be rectangular as shown in FIG. 9 (A), a plurality of vent holes 3*b* of the golf tee 16 may have the same area and the number of the vent holes may be increased as shown in FIG. 9 (B), or the areas of vent holes 3*c* of the golf tee 17 may be varied as shown in FIG. 9 (C).

Vent holes 3*d* and 3*e* of the golf tees 21 and 22 may be provided respectively between mutually adjacent supporting shafts in the circumferential direction as shown in FIGS. 9 (D) and (E), the shape of the vent hole 3*d* of the golf tee 21 may be oblong as shown in FIG. 9 (D), and the shape of the vent holes 3*e* of the golf tee 22 may be a laterally-elongated elliptical shape as shown in FIG. 9 (E).

Note that, the golf tees of FIGS. 9 (D) and (E) are set to have lower heights than that of FIGS. 9 (A), (B), and (C).

In the above described embodiments, the vent holes 3 are provided from the bottom end portion 6 to the top end portion 5 at approximately equal intervals; however, no limitation is imposed on by this.

Note that, the same also applies to the intervals of the vent holes 3 provided in the circumferential direction.

Furthermore, in the above described embodiments, the vent holes 3 are arranged from the bottom end portion 6 toward the top end portion 5, and the vent holes 3 are provided also in the circumferential direction of the golf tee 10; however, the vent holes 3 may be arranged merely in the direction from the bottom end portion 6 toward the top end portion 5, or the vent holes 3 may be provided merely in the circumferential direction of the golf tee 10.

In the above described embodiments, the notched portion 6*b* provided in the bottom end portion 6 of the golf tee 10 has an angular shape; however, no limitation is imposed on it, and it may be semicircular, arched, triangular, rectangular, etc.

Figure 10A:
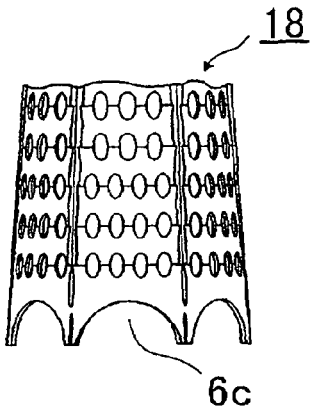
FIGS. 10(A), (B) and (C) are front views schematically showing bottom end portions of golf tees according to other embodiments.
Figure 10B:
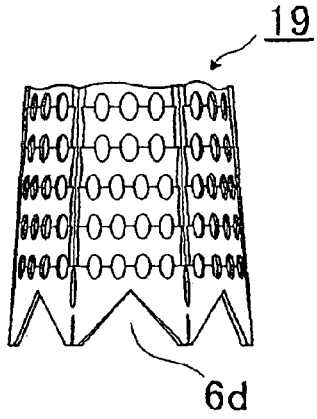
Figure 10C:
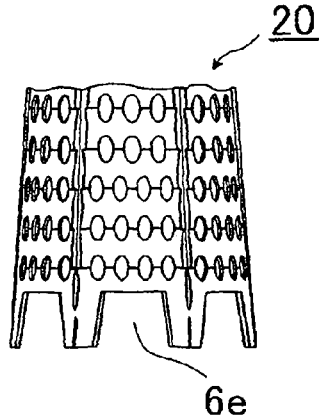
Figure 11:
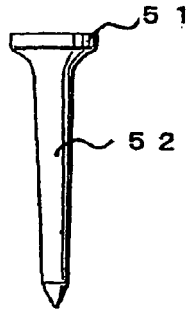
FIG.11 (PRIOR ART)
FIG. 11 is a front view schematically showing a golf tee of a conventional technique.

FIGS. 10 (A), (B), and (C) are front views schematically showing bottom end portions of golf tees according to other embodiments.

A notched portion 6*c* of the bottom end portion of the golf tee 18 may be semicircular as shown in FIG. 10 (A), a notched portion 6*d* of the bottom end portion of the golf tee 19 may be triangular as shown in FIG. 10 (B), and a notched portion 6*e* of the bottom end portion of the golf tee 18 may be rectangular as shown in FIG. 10 (C).

In the above described embodiment, the mark is provided on the golf tee 10; however, it may not be provided.

According to the present invention, they can be utilized as golf tees which are excellent in support stability and capable of preventing accompanying flight of the golf tees as much as possible.

The invention claimed is:

1. A circular truncated conical golf tee having a hollow structure with a bottom end portion placed on a ground surface and a top end portion on which a golf ball is placed during use, the golf tee comprising:

a shape restoring configuration;

a plurality of supporting shafts extending from the bottom end portion toward the top end portion;

sidewall portions thinner than the supporting shafts and being formed respectively between the supporting shafts; and a plurality of vent holes provided in each of the sidewall portions, wherein the bottom end portion comprises bottom end projecting portions formed by the supporting shafts and notched portions notching the sidewall portions, and the top end portion comprises top end projecting portions formed by the supporting shafts and the sidewall portions disposed between the mutually adjacent vent holes and parts of the vent holes.

2. The golf tee according to claim 1, wherein the closer the vent holes to the top end portion from the bottom end portion, the larger the areas of the vent holes.

3. The golf tee according to claim 1, wherein the vent holes are provided at approximately equal intervals from the bottom end portion toward the top end portion, and the golf tee can be cut by a plane perpendicular to a longitudinal direction of the golf tee.

4. The golf tee according to claim 1, wherein a plurality of the vent holes provided in a direction perpendicular to a longitudinal direction of the golf tee have the same shape, and the golf tee can be cut by a plane crossing the center each of the vent holes.

5. The golf tee according to claim 3, wherein a mark for cutting the vent hole is provided on the golf tee along a periphery of the vent hole.

6. The golf tee according to claim 1, wherein the notched portion has an angular shape.

7. The golf tee according to claim 1, wherein the golf tee is made from polyethylene and/or polypropylene.

8. A golf tee comprising:

a tubular sidewall structure defining a hollow interior and having a truncated conical configuration with a top end portion on which a golf ball is placed and a bottom end portion for placement on a ground surface during use of said golf tee, said sidewall structure comprising:

a plurality of supporting shafts extending in a longitudinal direction of said golf tee between said bottom end portion and said top end portion; and a plurality of sidewall portions, each said sidewall portion being disposed between an adjacent pair of said supporting shafts and having a thickness dimension which is less than a thickness dimension of each of said supporting shafts, each said sidewall portion defining therein a plurality of vent holes opening outwardly through an exterior of said sidewall structure and inwardly for communication with said hollow interior, each said sidewall portion at said bottom end portion of said sidewall structure defining therein a notch extending upwardly into said sidewall portion and opening downwardly between the adjacent pair of said supporting shafts;

said bottom end portion and said top end portion each including a plurality of projecting portions, each said projecting portion of said bottom end portion being formed by a lower end of one of said supporting shafts and each said projecting portion of said top end portion being formed by an upper end of said one supporting shaft.

9. The golf tee of claim 8, wherein said projecting portions of said top end portion are first projecting portions and extend in the longitudinal direction, and said top end portion includes a plurality of second projecting portions extending in the longitudinal direction, each said second projecting portion being defined by a part of one of said sidewall portions disposed and projecting upwardly between an adjacent pair of said vent holes disposed at said top end portion between the adjacent pair of said supporting shafts.

10. The golf tee of claim 9, wherein each said projecting portion of said bottom end portion extends in the longitudinal direction and is formed by said lower end of said one supporting shaft and parts of said sidewall portions disposed on opposite sides of said one supporting shaft, each said part having a lower edge defining an upper extent of one of said notches.

11. The golf tee of claim 8, wherein said vent holes are provided along the longitudinal direction of said golf tee, and sizes of said vent holes increase in the longitudinal direction from said bottom end portion to said top end portion.

12. The golf tee of claim 8, wherein said vent holes are provided along the longitudinal direction of said golf tee, and said vent holes are distributed at approximately equal intervals in the longitudinal direction from said bottom end portion to said top end portion, wherein a terminal edge of said top end portion is formed by cutting said golf tee in a plane perpendicular to the longitudinal direction.

13. The golf tee of claim 12, wherein a mark defining a guide for cutting said golf tee is disposed on said golf tee adjacent a periphery of one of said vent holes.

14. The golf tee of claim 8, wherein said sidewall structure has a substantially circular cross-section when viewed in a plane perpendicular to the longitudinal direction of said golf tee, said vent holes are distributed in a circumferential direction along said sidewall structure and have the same shape as one another, wherein a terminal edge of said top end portion is formed by cutting said golf tee in a plane which crosses a center of each of said vent holes distributed in the circumferential direction.

15. The golf tee of claim 8, wherein said sidewall structure has a substantially circular cross-section when viewed in a plane perpendicular to the longitudinal direction of said golf tee, said vent holes are distributed in a circumferential direction of said sidewall structure and have the same shape as one another at said top end portion, wherein a terminal edge of said top end portion is formed by cutting said golf tee in a plane which crosses a center of each of said vent holes at said top end portion.

16. The golf tee of claim 15, wherein said vent holes at said top end portion immediately adjacent said terminal edge each have an upwardly-opening U-shape.

17. The golf tee of claim 8, wherein each said notch has a substantially triangular shape.

18. The golf tee of claim 8, wherein said golf tee is constructed of polyethylene or polypropylene.

19. The golf tee of claim 8, wherein said golf tee is configured to have a shape-restoring property.

* * * * *